United States Patent [19]

Zwar et al.

[11] Patent Number: 5,056,743

[45] Date of Patent: Oct. 15, 1991

[54] ARM SUPPORT SYSTEM

[76] Inventors: Kurt F. Zwar, 3954 NE. 115th St., Seattle, Wash. 98125; Frederick W. Zwar, 13212 - 100th Pl. NE., Kirkland, Wash. 98034

[21] Appl. No.: 568,839

[22] Filed: Aug. 17, 1990

[51] Int. Cl.[5] ..... B68G 5/00

[52] U.S. Cl. ..... 248/118; 248/918; 400/715

[58] Field of Search ..... 248/118, 118.1, 118.3, 248/118.5, 918; 400/715

[56] References Cited

U.S. PATENT DOCUMENTS

| | | | |
|---|---|---|---|
| 988,893 | 4/1911 | Packewitz | 248/118.5 |
| 1,510,877 | 10/1924 | Wiedenmann | 248/118.5 |
| 1,627,635 | 5/1927 | Craig | 248/118.5 |
| 3,250,255 | 5/1966 | Cruickshank | 248/118.5 |
| 4,313,585 | 2/1982 | Bricker | 248/118.5 |

FOREIGN PATENT DOCUMENTS

| | | | |
|---|---|---|---|
| 0207799 | 3/1909 | Fed. Rep. of Germany | 248/118.1 |
| 0312262 | 5/1919 | Fed. Rep. of Germany | 248/118.1 |
| 0003750 | of 1893 | United Kingdom | 248/118.5 |

*Primary Examiner*—Ramon O. Ramirez

*Attorney, Agent, or Firm*—Christensen, O'Connor Johnson & Kindness

[57] ABSTRACT

A ergonomic arm support system for reducing the physical loading of an operator's upper extremities and neck during keying operations is disclosed. The support system includes a hand board and a pair of hand pads that are positioned on the hand board. The coefficient of friction between the hand board and the hand pads is minimal. The support system is installed between a keyboard, such as a computer keyboard, a typewriter, or some other key pad device, and the operator. In use, an operator's hands are supported by the hand pads during keying and rest periods. The hand pads slide freely over the hand board, allowing unrestricted freedom of hand movement over the entire keyboard and into a resting position.

11 Claims, 3 Drawing Sheets

ARM SUPPORT SYSTEM

FIELD OF THE INVENTION

This invention relates to an arm support system for computer keyboards and typewriters and, in particular, to an ergonomic support system for reducing the physical loading imposed on an operator during keying and resting periods.

BACKGROUND OF THE INVENTION

Computer keyboard operators face several problems, especially when involved in high production work. The operation of a computer keyboard for an extended period of time causes physical loading of the operator's neck and upper extremities. Similar problems are experienced by operators of conventional typewriters and other devices including key pads.

There is an abundance of data demonstrating that the human body uses many anti-gravity muscles in the hands, arms, shoulder girdle, neck and back during the operation of computer keyboards. Most of these muscles must remain contracted to keep the hands in position over the computer keyboard. Other muscles move the hands over the keyboard. As a result, many muscles get little rest during repetitive and continuous keying operations. Little benefit is obtained when the operator is not keying, for example, when the operator is waiting for a command to be processed by the computer. During this period, the hands may still be rigidly held above the keyboard and/or the wrists may rest on an edge of the keyboard. In the latter case, muscles in the arms and upper extremities may still be contracted. This situation creates many barriers to productive work, including: the requirement of frequent rest periods for tired muscles; the deterioration of correct keying technique over a work period; the development of overuse and repetitive motion injuries to hands, wrists (especially in the Median Nerve and Carpal Tunnel region), elbows, shoulders and neck; and the overloading of the shoulder, scapular and cervical regions (muscles, tendons and nerves) by the continuous weight of the upper extremities.

The demanding use of computers has created a twofold problem related to arm support and mobility during keying operations. Existing keyboard hand rest devices assist an operator by providing a stationary resting board adjacent the keyboard. Such boards are essentially flat or curved planes supporting the wrist in a static rest position when keying is terminated. Such stationary supports are not effective when the operator is typing; there is no design feature to permit rapid movement over the complete keyboard while the wrists or forearms are at rest. The stationary hand rest devices do not address the functional requirements for easy movement of the hands over the keyboard in high speed operation.

SUMMARY OF THE INVENTION

The arm support system of the present invention includes a hand pad device, such as a pair of anatomically contoured hand pads, upon which the hands rest, and a hand board. The hand pads rest on the hand board. The hand pads and hand board have a low friction interface to limit the forces necessary to produce movement of the hand pads over the hand board. The amount of force required to move a hand pad is within a range such that arm movement of the operator is not unduly impeded. The hand board is a plane bearing surface. The hand board extends the width of the keyboard, lies coplanar with the keyboard, and is positioned between the keyboard and the operator. In use, a hand pad is positioned under the proximal hand; the operator is allowed freedom of hand and finger motion over the entire keyboard for key activation.

In accordance with other aspects of the present invention, a support surface is connected to the hand board. The support surface is positioned below the keyboard and maintains the positions of the keyboard and hand board in a fixed relationship. This ensures proper hand board-keyboard alignment. The support surface may also provide a hinge for adjustably securing the angular position of the hand board.

In accordance with still further aspects of the present invention, the keyboard is clamped between the hand board and support surface so as to secure the position of the arm support system relative to the keyboard.

The arm support system of the present invention provides means by which computer keyboard operators or typists can perform their tasks without subjecting themselves to excessive physical loading of their upper extremities and neck. This in turn can reduce frequent rest periods, deterioration in keyboard operator efficiency, repetitive motion injuries, and unsupported upper extremity forces. The invention allows for and enhances the normal high-speed operation that is often required by current technology and business.

BRIEF DESCRIPTION OF THE DRAWINGS

The foregoing abstracts and the attendant advantages of this invention will become more readily appreciated and the same become better understood by reference to the following detailed description, when taken in conjunction with the accompanying drawings, wherein.

DETAILED DESCRIPTION OF THE PREFERRED EMBODIMENTS

Figure 1:
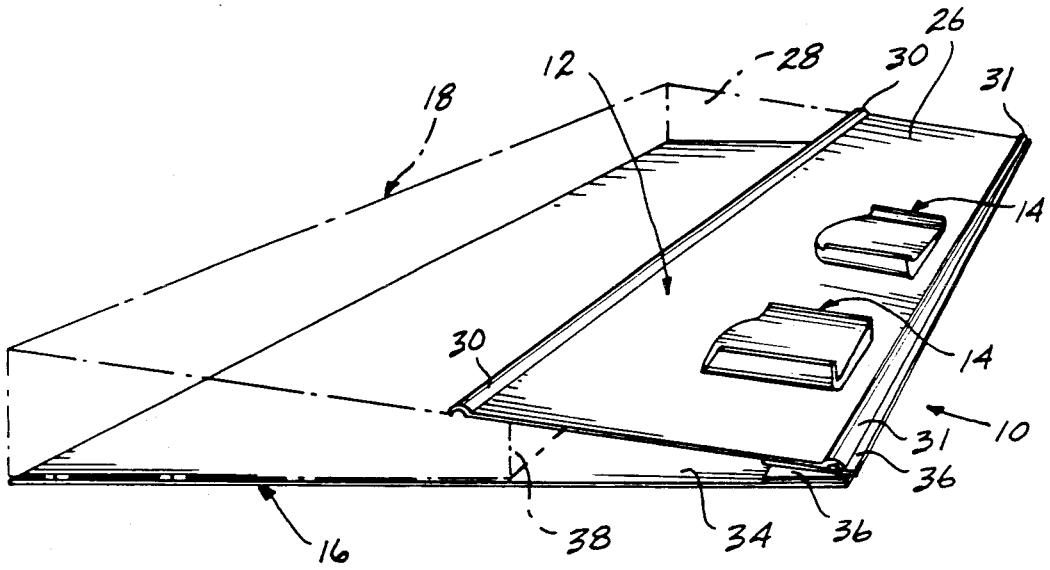
FIG. 1 is a perspective view of an arm support system in accordance with the present invention.
Figure 2:
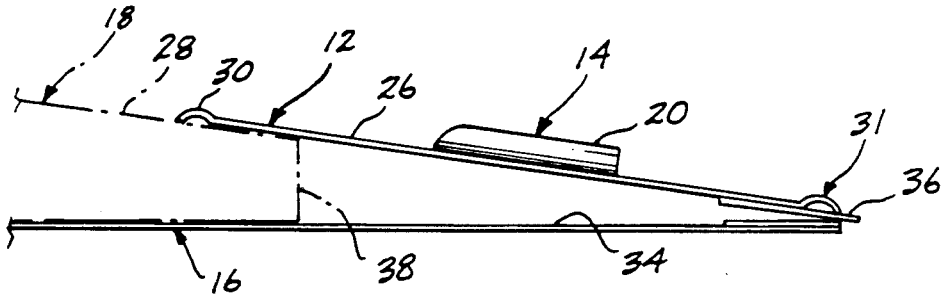
FIG. 2 is a side view of an arm support system as illustrated in FIG. 1.

The present invention is an ergonomic arm support system designed for use with a computer keyboard, typewriter, or other device including a key pad over which an operator must support and/or move his or her hands. With reference to FIGS. 1 and 2, the arm support system 10 includes hand board 12, hand pads 14, and support surface 16. The hand pads 14 move freely over the hand board. During use, the arm support system 10 is located between a computer keyboard 18 (shown in reference) and an operator. The operator rests her hands on the hand pads, which support the hands over the keyboard or the hand board. The hand pads move over the hand board in conjunction with the movement of the operator's hands. The operator can easily move the hands over the keyboard during keying and off the keyboard during resting or waiting periods. The arm support system reduces the load on the operator's upper extremities and neck during these types of activities.

Figure 3A:
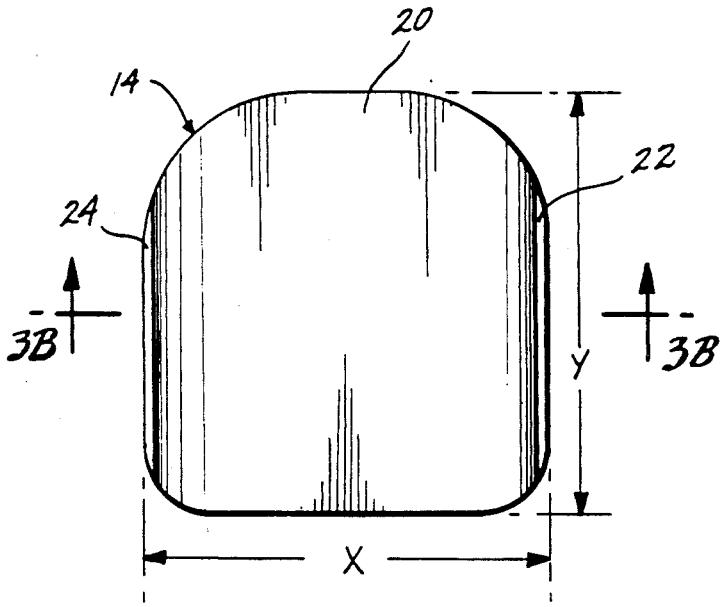
FIGS. 3A–C are a top view of a left hand pad (3A), a cross-sectional view of a left hand pad taken through the line indicated in FIG. 3A (3B), and a similar cross-sectional view of a right hand pad (3C), in accordance with the present invention.
Figure 3B:
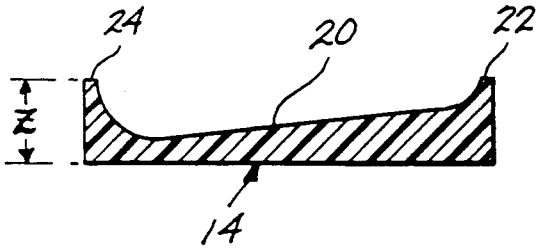
Figure 3C:
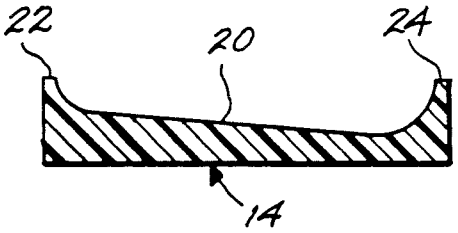

With reference to FIGS. 3A-3C, the hand pads 14 for the left and right hands are designed as mirror images of one another. The hand pads are anatomically contoured to match the plane of each hand in the area of the base of the hand and the wrist. The top surfaces 20 of the hand pads are angled to support the hands in natural rest positions; the surfaces are angled from the center edges 22 downwardly and outwardly towards the outside edges 24. The angling precludes the introduction of undesired wrist rotations. The hand pad edges 22 and 24 are raised slightly to react against the hand and prevent the hands from sliding off the hand pads. Additionally, the top surfaces 20 are designed to provide friction between the pad and the hand. This may be achieved by texturing (not shown) the top surfaces.

In one embodiment, the pads are approximately two and one-half inches in width X and length Y and approximately one-half inch high Z. These dimensions provide adequate area to support an average size hand and wrist and adequate clearance of the hands above the hand board to allow for operation of the keyboard.

The materials of the top surface 26 of the hand board 12 and under surfaces (not shown) of the hand pads 14 are preferably chosen to result in frictional forces that are greater than zero and less than a level that would require noticeable effort by the operator to produce the motion. Sliding plane surfaces with a maximum coefficient of friction of approximately 0.25 satisfies this requirement. In one embodiment, the hand board top surface 26 is made of polished stainless steel and the lower hand pad surfaces are made of TEFLON material, made by E. I. DuPont de Nemours & Co. of Wilmington, Del. High-speed hand movement is further enhanced by minimization of the hand pad weight.

With reference again to FIGS. 1 and 2, the hand board 12 is positioned to be essentially coplanar with the plane of the keyboard upper surface 28; the operator's arms do not have to be lifted from the hand pads during keying or when resting. When the operator's arms are supported by the hand pads, the hands remain at a relatively constant elevation relative to the keyboard whether the operator is keying or resting. This reduces physical stress on the operator since the hands do not need to be lifted from the keyboard.

In one preferred embodiment, edges 30 and 31 of the hand board 12 are slightly raised. The edges contain the hand pad motion within the confines of the hand board. This prevents the hand pads from sliding off the lower edge of the hand board, e.g., into the operator's lap, and off the upper edge of the hand board onto the keyboard. The side edges of the hand board may also be raised. However, because of the configuration of the hand pads and the normal range of hand movement over the keyboard, the hand pads do not generally approach the side edges of the hand board.

The support surface 16 is positioned below the keyboard and hand board. The upper surface 34 of the support surface, which is in physical contact with the keyboard, may be coated with a material with a high coefficient of friction to maintain the position of the arm support system 10 relative to the keyboard. For example, the support surface may include rubber-type coating on the upper surface. Alternatively, the support surface may be formed entirely from a rubber-type material that is rigid enough to support the hand board and also provides the desired high friction surface.

In one preferred embodiment, the support surface is connected to the hand board by a hinge 36. Preferably, the hinge runs the length of the hand board and the support surface. The keyboard is positioned on the support surface 16 so that the forward edge 38 of the keyboard is beneath the hand board 12. In this manner, the hand board edge 30 rests on and is supported by the keyboard. The range of motion of hinge 36 accommodates keyboard height variations. A common range of heights for keyboard forward edges is three-eighths to one-half inch. Thus, the hinge need only have a range of motion up to approximately ten degrees (10°) to accommodate most standard keyboards.

Figure 4:
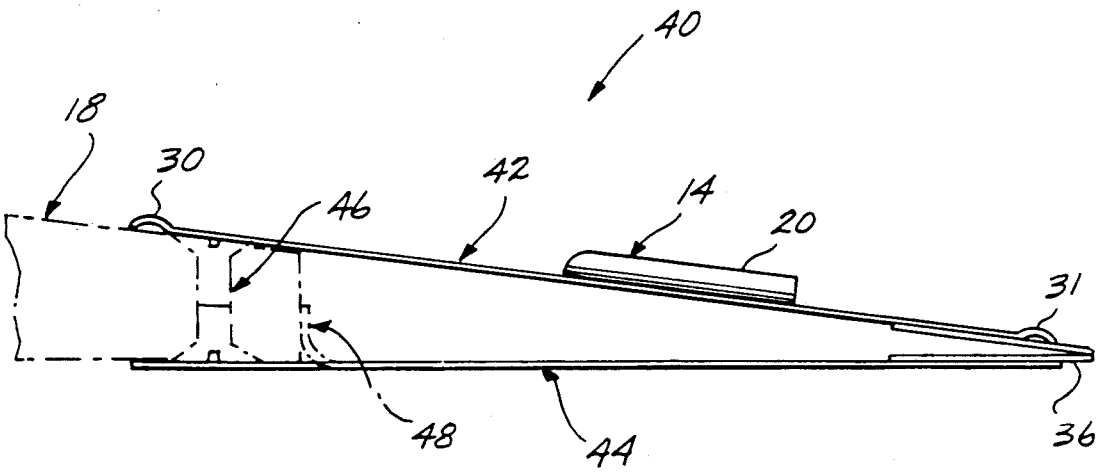
FIG. 4 is a side view of an alternative embodiment of an arm support system in accordance with the present invention.
Figure 5:
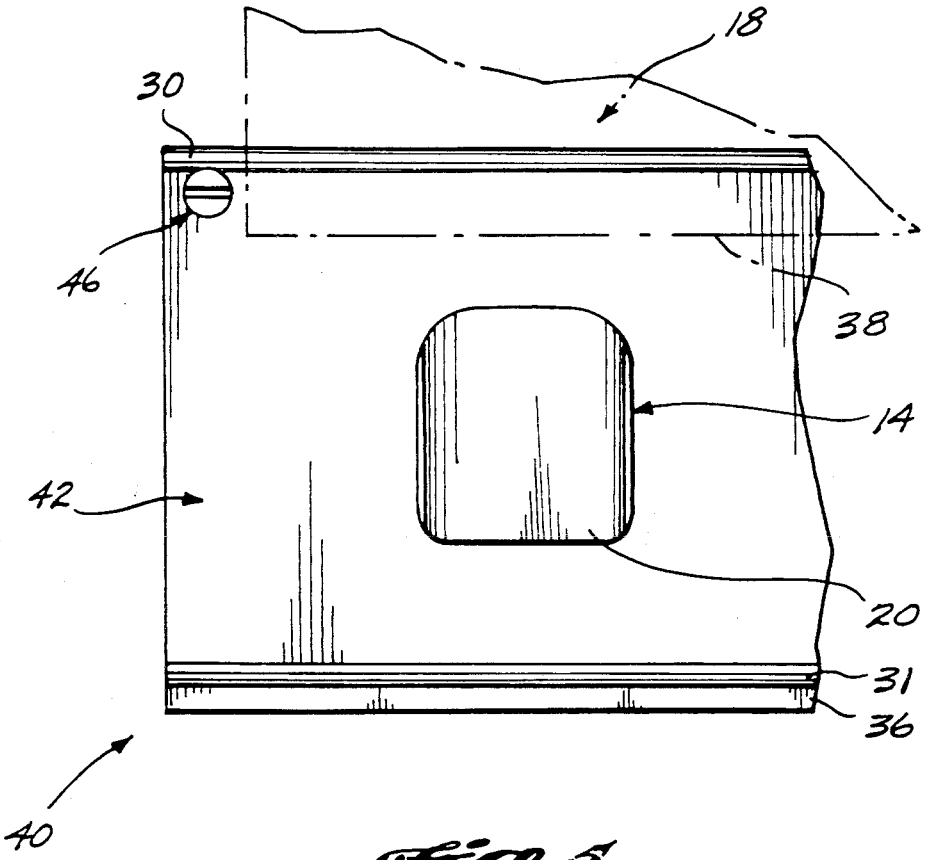
FIG. 5 is a partial top view of the arm support system illustrated in FIG. 4, with a portion of the hand board cut-away to expose the forward edge of the keyboard.

With reference to FIGS. 4 and 5, an alternative preferred embodiment of the arm support system 40 includes a hand board 42 and a support surface 44. The hand board and the support surface are wider than the keyboard 18 and are fastened together at their ends by connectors 46. The connectors may be a male/female screw pair, with one end fastened to and extending upwardly from the support surface. The other end is inserted through a hole in the hand board and tightened into the upwardly extending end. By so tightening the connectors, the keyboard is clamped between the hand board and the support surface of the arm support system. Thus, the position of the system relative to the keyboard is fixed. The support surface 44 does not extend below the keyboard since the support surface-to-keyboard interface is not required to maintain the relative positions of the keyboard and arm support system.

Tabs 48 may be provided on the support surface for aiding in the positioning of the keyboard relative to the arm support system. The tabs are positioned on the support surface to prevent the keyboard from sliding too far between the support surface and the hand board when the keyboard is being positioned.

While preferred embodiments of the invention have been illustrated and described, it will be appreciated that various changes can be made therein without departing from the spirit and scope of the invention. The arm support system of the present invention largely eliminates the excessive loading of the upper extremities and neck during keying and/or resting processes. This is done by providing support of the hands and requiring low force to move the hands for keyboard operations. The system components provide support for the hands while permitting complete and unrestricted operation of all keyboard keys.

The embodiments of the invention in which an exclusive property or privilege is claimed are defined as follows:

1. An arm support system for use in conjunction with a keyboard, the support comprising:

(a) a hand board including a bearing surface, said hand board being positionable adjacent the keyboard;

(b) hand pad means positionable on said hand board, the interface between said hand board and said hand pad means providing minimum friction such that the hand pad means slides freely over said hand board, whereby the physical loading of an operator's upper extremities and neck are reduced by allowing the operator to support a hand on said hand pad means during keying operations performed via the keyboard and during rest periods.

2. An arm support system as claimed in claim 1, wherein said hand pad means includes a pair of anatomically contoured hand pads.

3. An arm support system as claimed in claim 2, wherein said hand pads include angled upper surfaces, whereby when an operator's hands and wrists are placed on said hand pads they are naturally positioned and undue rotation of the wrists are prevented.

4. An arm support as claimed in claim 1, wherein said hand board is positioned coplanar with the keyboard.

5. An arm support system as claimed in claim 1, further including a support surface connected to said hand board, whereby said support surface maintains said hand board in a position adjacent the keyboard.

6. An arm support system as claimed in claim 5, wherein said support surface is connected to said hand board by a hinge means, said hinge means having a range of angular motion that allows the angular position of said hand board to be adjusted.

7. An arm support system as claimed in claim 5, wherein the interface between said support surface and the keyboard maintains the keyboard in position relative to said support surface.

8. An arm support system as claimed in claim 1, further including a support surface connected to said hand board, wherein said hand board and support surface are connected by fastening means for securing said hand board in a position adjacent the keyboard.

9. An arm support system as claimed in claim 8, wherein said support surface is connected to said hand board by a hinge means, said hinge means having a range of angular motion that allows the angular position of said hand board to be adjusted.

10. An arm support system as claimed in claim 1, wherein said interface between said hand board and said hand pad means is subject to a maximum coefficient of friction of approximately 0.25.

11. An arm support system as claimed in claim 1, wherein said hand board includes parallel raised edges for maintaining said hand pad means on said hand board between said raised edges.

* * * * *